United States Patent [19]

Gerber

[11] 4,369,601

[45] Jan. 25, 1983

[54] APPARATUS FOR TRACKING BELT FOR ABRASIVE GRINDING MACHINE

[75] Inventor: Dennis J. Gerber, Minneapolis, Minn.

[73] Assignee: Acrometal Products, Inc., Minneapolis, Minn.

[21] Appl. No.: 228,946

[22] Filed: Jan. 27, 1981

[51] Int. Cl.[3] ..... B24B 21/18

[52] U.S. Cl. ..... 51/135 BT

[58] Field of Search ..... 51/135 R, 135 BT

[56] References Cited

U.S. PATENT DOCUMENTS 3,745,717 7/1973 Robinson ..... 51/135 BT 4,187,645 2/1980 Lind ..... 51/135 BT

*Primary Examiner*—Harold D. Whitehead

*Attorney, Agent, or Firm*—Merchant, Gould, Smith, Edell, Welter & Schmidt

[57] ABSTRACT

The invention is directed to apparatus for controlling the lateral tracking movement of a wide abrasive belt back and forth over back supporting rollers. The apparatus is employed in the grinding head of an abrasive grinding machine in which the endless abrasive belt is movably carried by at least two spaced rollers. The upper roller is rotatably mounted in a cradle that pivots within the grinding head about an axis perpendicular to the roller axis and passing through the roller midpoint. Pivotal swinging of the cradle about this axis, as effected by opposed pneumatic actuators, causes the abrasive belt to track back and forth over the rollers. The tracking movement is cyclically controlled by a photodetector that cooperates with a solenoid valve to alternately actuate the pneumatic actuators. The photodetector comprises a radiation source generating a beam of radiated energy and a detector having a radiation detecting view field, the source and detector being disposed so that the radiation beam and view field intersect in a predetermined region. The photodetector is protectively disposed between the abrasive belt flights and carried so that the predetermined region may be traversed by one edge of the abrasive belt to control the solenoid valve.

14 Claims, 6 Drawing Figures

APPARATUS FOR TRACKING BELT FOR ABRASIVE GRINDING MACHINE

TECHNICAL FIELD

The invention relates to endless belt tracking control systems for abrasive grinding machines.

BACKGROUND OF THE INVENTION

Abrasive grinding machines typically employ a wide endless abrasive belt that is movably supported in tension between at least two aligned rollers one of which is driven. In a two-roller grinding head, one roller is disposed above the other, the lower roller being driven and serving as the contact roller with workpieces moved thereunder by a conveyor belt. In three-roller grinding heads, two lower rollers spaced identically from the conveyor belt are used with an upper roller. A platen is disposed between the lower rollers in backing support to the abrasive belt to effect the desired abrading function.

In either case, the endless belt is driven around the rollers longitudinally either against or with movement of the workpiece, depending on the surfacing function to be accomplished. In addition, it is now well recognized that controlled, lateral movement or tracking of the endless abrasive belt back and forth across the rollers can be beneficial to the overall process to achieve more uniform wear of the abrasive belt as well as to more effectively deal with the limited degree of inherent lateral belt movement.

Consequently, it is conventional for abrasive grinding machines to include some type of tracking means for causing the wide abrasive belt to move back and forth within predetermined outer limits; i.e., the belt is caused to move laterally in one direction to a predetermined point at one end of the rollers, at which point belt movement is reversed to a predetermined point at the opposite end of the rollers. The cycle repeats on a uniform periodic basis.

One type of tracking means consists of a cradle in which the upper roller is mounted so that it not only rotates about its own longitudinal axis, but also pivotally swings back and forth about a pivot axis perpendicular to the rotational axis and passing through its midpoint. This permits the upper roller to pivotally swing either direction from a position in which it is parallel with the lower roller or rollers into a nonparallel or skew position. With the upper roller in nonparallel position, tension on the belt is non-uniform and it moves laterally over the belt in a direction corresponding to the direction and degree of skew.

Back and forth swinging movement of the cradle is accomplished with a pair of pneumatic actuators that are mounted on opposite sides of the cradle and are alternately actuated as a function of belt position. Position of the belt is sensed by a detector that conventionally takes the form of a light source and photocell that are disposed on opposite sides of one flight of the belt, so that one edge traverses the light beam as the belt moves laterally in one direction and leaves the beam as it moves in the opposite direction. The pneumatic actuators are alternately actuated as the light beam is broken and then reestablished.

Several problems arise with belt movement detectors due to the nature of abrasive grinding machines. First, it is difficult if not impossible to utilize a detector that senses movement by actual contact with the belt because the belt moves at a significant linear velocity and is abrasive. The light beam/photocell approach is a satisfactory solution to this problem, but creates other problems of its own. For example, it requires two components (i.e., the light source and the photocell detector) that must be mounted in opposition on opposite sides of the belt in order to permit the belt edge to traverse the light beam. This inherently creates alignment problems between the two components due to machine vibration or other movement. Further, while one component may be protectively mounted inside the belt (i.e., between the belt flights), the other component must be disposed externally of the belt in a position which is far more vulnerable to misalignment and/or damage. Further, the external component is directly exposed to wood dust that is carried and thrown by the external abrasive face of the belt during the grinding or surfacing operation. Although most abrasive grinding machines include dust collection systems, none is totally effective in dust removal and the external detecting component must be positioned in this dusty environment. This obviously has an adverse effect on its ability to properly generate or sense the light beam, and it is possible for the detector to generate a spurious signal due to improper sensing of a dust buildup.

SUMMARY OF THE INVENTION

This invention is directed to an improved system for controlling the tracking means, and specifically contemplates the use of an improved sensor that does not require contact with the belt or separate aligned components. The sensor is of the optical type and comprises a pulsed, light-emitting diode as a source of radiated energy with a light detector in a single housing. The detector is positioned within the housing so that its field of view converges with the beam of radiated energy in a predetermined area of intersection, as distinguished from aligning separate light source and detector components in opposition to each other.

The sensor is protectively mounted adjacent the inner, nonabrasive surface of the belt in a position so that the aforementioned area of intersection of the radiated beam and field of view may be traversed by the belt edge as it moves in one direction. This generates a first signal actuating the solenoid of a two-position, four-way pneumatic valve, which in turn actuates one of two pneumatic actuators. As the belt leaves the area of intersection, a second signal is generated, causing the solenoid valve to move to its opposite position, actuating the second pneumatic actuator.

The improved control system has been found to operate satisfactorly over long periods of time without the need for realignment or for periodic cleaning due to the dusty environment. As a result, the entire tracking system is capable of operating over extended periods of time without the maintenance and/or repair necessary with prior systems.

DETAILED DESCRIPTION OF THE INVENTION

Figure 1:
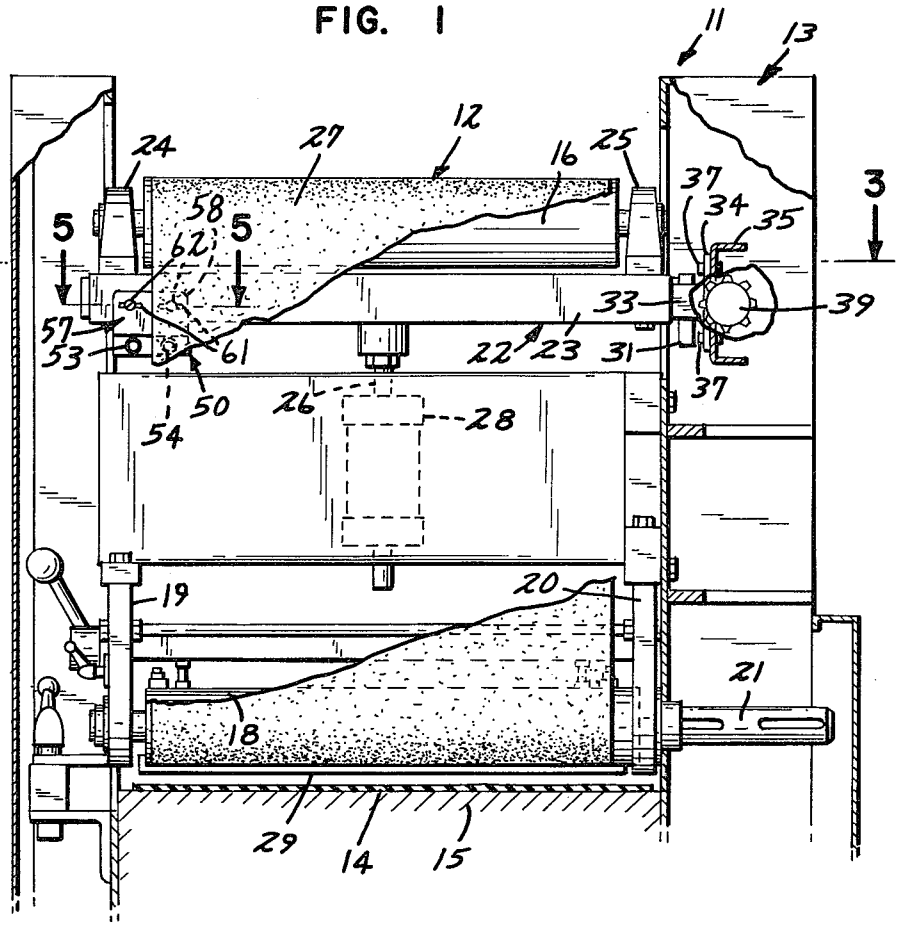
FIG. 1 is a fragmentary view in front elevation of an abrasive grinding machine embodying the subject invention, portions of which are broken away and shown in section for purposes of clarity.
Figure 2:
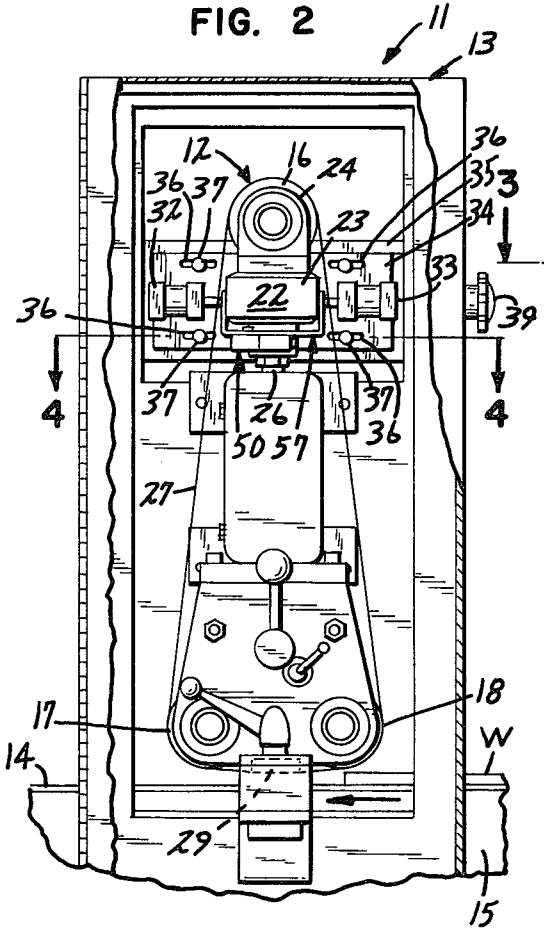
FIG. 2 is a fragmentary view of the abrasive grinding machine in side elevation, portions thereof being broken away and shown in section.
Figures 3, 4, 5:
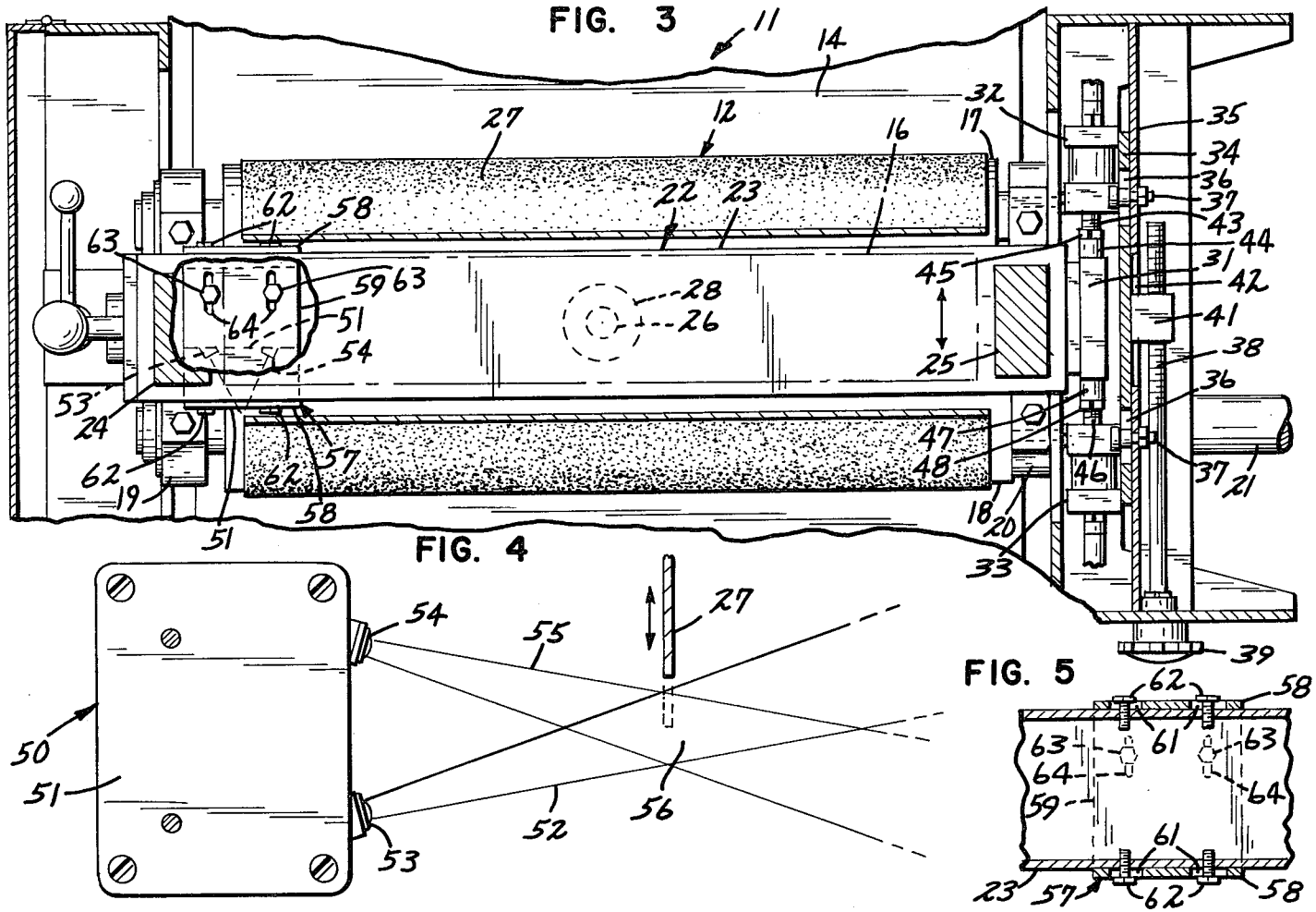
FIG. 3 is an enlarged fragmentary sectional view of the abrasive grinding machine taken along the line 3—3 of FIG. 1, portions of which are broken away and shown in section.
FIG. 4 is an enlarged somewhat schematic view of one edge of an endless abrasive belt in section and a sensing device for detecting lateral movement of the belt edge.
FIG. 5 is an enlarged fragmentary sectional view taken along the line 5—5 of FIG. 1.

With initial reference to FIGS. 1-3, an abrasive grinding machine is represented generally by the numeral 11. Machine 11 comprises a grinding head 12 which is suitably mounted in a frame means 13 that also serves to support an endless conveyor belt 14 that moves work pieces W over the planar surface of a support bed 15.

The grinding head 12 specifically comprises an upper roller 16 and a pair of lower rollers 17, 18. The lower rollers 17, 18 are journaled in fixed relation between a pair of upstanding side members 19, 20 of the frame means 13. As shown in FIG. 1, roller 18 is coupled to a drive shaft 21 which is driven by an electric motor through a gear drive, neither of which is shown.

Upper roller 16 is journaled in a cradle 22 comprising a cross beam 23 and opposed, upstanding sides 24, 25. The cradle 22 further comprises a pivot shaft 26 that projects downward from a midpoint of the beam 23 in perpendicular relation to the rotational axis of upper roller 16. The pivot shaft 26 is rotatably carried within a bearing 28 suitably mounted to the frame means, permitting the cradle 22 and roller 16 to swing back and forth about the axis of the shaft 21.

An endless abrasive belt 27 encircles the rollers 16-18, the lower flight thereof extending between the lower rollers 17, 18 in spaced relation to the plane of the conveyor belt 14. A pressure platen 29 is suitably mounted in a fixed position to the frame means 13 in a backing position to the inner face of the endless abrasive belt 27. The pressure platen 29 defines a bottom surface that is disposed in substantially parallel relation to the conveyor belt 14 and projects slightly below the bottom periphery of the rollers 17, 18. As such, the platen 29 exerts downward pressure on the inner or backing surface of the abrasive belt 27 as it moves around the rollers 16-18, causing uniform abrasive engagement with each work piece W as it moves thereby on the conveyor 14.

The feed conveyor belt 14 is driven in the direction shown in FIG. 2 by means not shown. The bed 15 is vertically adjustable by means not shown to vary the spacing between the conveyor belt 14 and abrasive belt 27 in the grinding area in order for the work pieces W to be surfaced through a predetermined thickness. Movement of the abrasive belt 27 may be in either direction depending on the application. Typically, the abrasive belt 27 moves against the direction of the conveyor belt 14 for woodwork pieces, and with the conveyor belt 14 for grinding or surfacing metal workpieces.

If the rollers 16-18 were perfectly parallel to one another and every abrasive belt were uniformly dimensioned over the entire width, theoretically there would be no lateral movement of the abrasive belt relative to the rollers in either direction. In practicality, there is an inherent tendency of the belt 27 to move laterally in one direction or the other due to roller misalignment or imperfections in the belt itself. For this reason, and also to achieve more uniform belt wear, the abrasive belt 27 is caused to track laterally back and forth on the rollers 16-18 through controlled, cyclical pivotal movement of the roller 16 and cradle 22 about the shaft 26, as indicated by the arrow in FIG. 3.

With continued reference to FIG. 3, when the cradle 22 is pivotally swung a small amount in either a clockwise or counterclockwise direction about the shaft 26, the roller 16 will be in a nonparallel or skew relation relative to the rollers 17, 18, and this effects a corresponding lateral tracking movement of the belt 27 over the rollers in one direction or the other.

The cradle 22 further comprises an extension block 31 projecting from the right end thereof that is disposed between two single acting pneumatic actuators 32, 33. The actuators 32, 33 are secured to a rectangular mounting plate 34 that is slideably adjustable relative to a fixed plate 35 forming part of the frame means 13. This lateral adjustment is accomplished through the formation of four elongated slots 36 in the plate 34 which are registrable with a like number of bores in the plate 35. Four shoulder bolts 37 lock the plates 34, 35 together when the proper adjustment has been obtained.

Slideable adjustment of the plate 34 (with the shoulder bolts 37 loosened) is accomplished by a threaded rod 38 rotatably mounted in the frame means 13 and including an externally accessible handle 39. The rod 38 threadably cooperates with a projecting block 41 that is secured to the middle of the rectangular mounting plate 34 and which projects through and slides in an elongated slot 42 formed in the fixed plate 35.

The pneumatic actuator 32 includes a threaded extensible and retractable rod 43 that carries a threaded spacer 44 and lock nut 45. Actuator 33 includes an identical threaded rod 46, threaded spacer 47, and lock nut 48.

The spacers 44, 47 and lock nuts 45, 48 are adjusted to engage and bear against the sides of the extension block 31 of cradle 22 as shown in FIG. 3. With the abrasive belt 27 running and the shoulder bolts 37 loosened, the handle 39 is rotated until the belt 27 is in a desired position on the rollers 16-18. With the machine shut down, the shoulder bolts 37 are tightened to lock mounting plate 34 in a fixed position to plate 35. Thereafter, the pneumatic actuators 32, 33 are alternately actuated by the control system discussed below. With the threaded rod 43 of actuator 32 extended, the rod 46 of actuator 33 is simultaneously retracted, causing the cradle 22 and upper roller 16 to pivotally swing a small amount in the clockwise direction, causing the belt 27 to move to the right side of the rollers 16-18 as shown in FIG. 3. When rod 46 is extended, the rod 43 is retracted and the cradle 22 and roller 16 are pivoted slightly in the counterclockwise direction, causing the abrasive belt 27 to move laterally to the left side of the rollers 16-18.

The alternate operation of pneumatic actuators 32, 33 results from sensing the position of belt 27 with a sensor bearing the generally reference numeral 50 in FIGS. 1, 3, 4 and 6.

Sensor 50 is a commercially available device of the optical type that employs a pulsed light-emitting diode to generate a beam or pattern of radiated energy 52 from a source 53 including the light emitting diode and lense opening. A detector 54 defines a field of view 55 that intersects with the beam 52 in a predetermined area 56. Both the source 53 and detector 54 are mounted in the desired manner in a housing 51 of rectangular configuration.

The sensor 50 is adjustably mounted on the cradle 22 in a manner described below so that the abrasive belt 27 traverses the intersecting area 56 as it moves laterally. In addition to the radiation source 53 and detector 54, the sensor 50 also includes an amplifier, a demodulator including delay circuitry, output circuitry and a power supply. It generates a first delayed electrical signal as the abrasive belt 27 moves into the intersecting area 56 and a second delayed electrical signal when the abrasive belt 27 moves from the area 56.

The adjustable mounting for the sensor 50 is shown in FIGS. 1, 3 and 5, and comprises a U-shaped bracket 57 having upstanding sides 58 and a bottom 59. The bracket 57 is sized so that the sides engage and overly the sides of the cross beam 23 (FIG. 5). Slots 61 in the sides 58 and screws 62 permit a slight degree of lateral adjustment of the bracket 57 relative to the longitudinal dimension of the cross beam 23.

The sensor housing 51 is secured directly to the bottom 59 of bracket 57 with a pair of screws 63. Slots 64 formed in the bottom 59 permit adjustment of the sensor 50 toward and away from the inner face of belt 27.

The sensor 50 is adjusted as shown in FIGS. 3 and 4, so that the abrasive belt 27 traverses the intersecting area 56 as it tracks laterally over the rollers 16–18. The adjustment slots 63 ensure that the area 56 is traversed at the proper depth for maximum signal strength. The slots 61 permit lateral adjustment of the sensor 50 so that the belt 27 begins to traverse the area 56 at the desired point.

Figure 6:
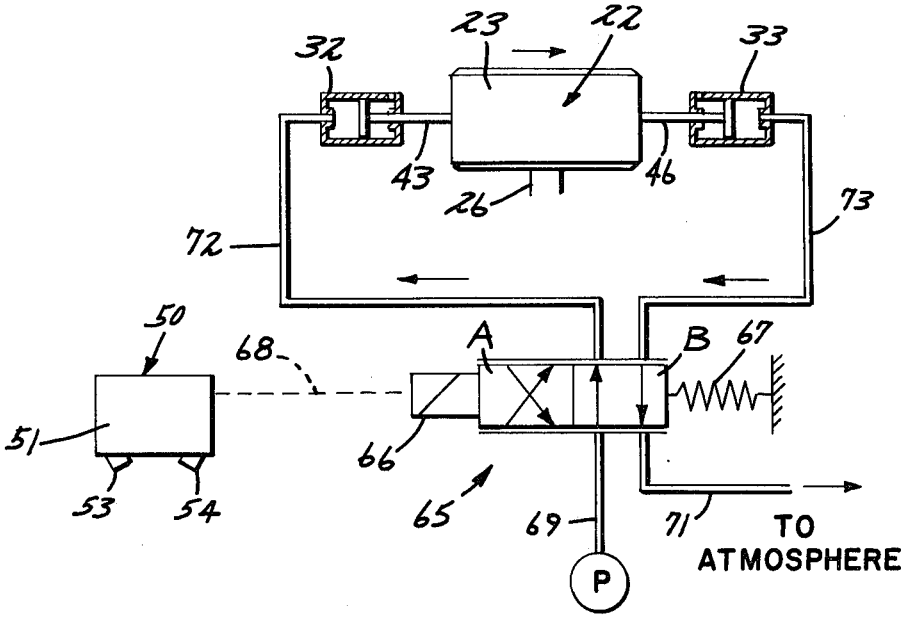
FIG. 6 is a schematic representation of a control system for controlling lateral tracking movement of the endless abrasive belt, such system including the sensing device of FIG. 4.

With reference to FIG. 6, a control system for cyclically providing the cradle 22 and roller 16 back and forth is shown to include the actuators 32, 33, the sensor 50 and a solenoid valve represented generally by the numeral 65. Valve 65 comprises a solenoid 66 operably connected to a two-position, four-way valve having a first section A and a second section B. The valve is normally biased with the B section in the operative position by a spring 67.

The control system further comprises an electrical line 68 connecting sensor 50 with solenoid 66, a source of pressure P connected to the valve 65 through a pneumatic line 69, a pneumatic line 71 leading from the valve 65 to atmosphere, a pneumatic line 72 leading from the valve 65 to the pneumatic actuator 32 and a pneumatic line 73 leading from the valve 65 to the actuator 33.

When the abrasive belt 27 leaves the intersecting area 56, a delayed signal is generated, and the solenoid 66 is in a nonenergized state. The spring 67 biases section B to the normal position shown in FIG. 6 with actuator 32 pressurized and actuator 33 exhausted to atmosphere. When the abrasive belt 27 traverses the area 56, detector 51 generates another delayed signal through line 68 to solenoid 66, moving the valve section A to the operative position, pressurizing actuator 33 and exhausting actuator 32.

The control system and tracking means are constructed and adjusted to cooperate as follows. Assuming the pneumatic actuators 32, 33 to be in a first state of actuation, the abrasive belt 27 moves from right to left until its edge intersects the area 56. A first signal from the sensor 50 is generated through the line 68, but only after a predetermined delay inherent in the circuitry of sensor 50 has occurred. During this delay, the abrasive belt 27 continues to move a predetermined distance from right to left, approaching its left limit point on the rollers 16–18. During this time, the solenoid valve 65 is in the position shown in FIG. 6, with the solenoid 66 in a nonenergized state and with spring 67 biasing valve section B to the operative position. As such, pneumatic actuator 32 is in the extended position and actuator 33 is in the retracted position.

After the delay, the signal generated by the belt 27 intersecting area 56 energizes solenoid 66, moving valve section A to the opposite position against the bias of spring 67. This causes actuator 33 to extend and actuator 32 to retract, and instantaneously reverses the direction of belt movement from left to right over the rollers 16–18.

As shown in FIG. 4, the point at which belt 27 begins its reversed movement is well into the area 56, and it must move in the opposite direction the same amount before it leaves the area 56. When the belt 27 leaves the area 56, a second signal is generated by sensor 50, but also on a delayed basis. Consequently, the belt 27 moves further from left to right before the second signal is generated through the line 68. In the preferred embodiment, the second signal is a null signal, deenergizing the solenoid 66 and permitting the spring 67 to return valve section B to the operative position and reversing the actuators 32, 33.

What is claimed is:

1. An abrasive grinding machine including a grinding head having an endless abrasive belt movably carried by at least two spaced rollers to define at least two spaced flights, drive means for driving one of the rollers and tracking means operative in first and second modes for respectively causing the abrasive belt to move laterally back and forth over the rollers, the improvement which comprises:

(a) photodetector means comprising a radiation source generating a beam of radiated energy and a detector having a radiation detecting view field, means mounting the source and detector so that the radiation beam and view field intersect in a predetermined region, and so that said source and detector are protectively disposed between said flights and arranged so that said predetermined region is traversed by only one edge of the abrasive belt;

(b) said photodetector means generating a first signal upon entry of said one edge of the abrasive belt into the predetermined region, and a second signal upon said one edge of the abrasive belt leaving said predetermined region;

(c) and control means operatively connected to the photodetector means for causing the tracking means to operate in one of said first and second modes in response to said first signal and for operating in the other of said first and second modes in response to said second signal.

2. The combination defined by claim 1, wherein the tracking means comprises:

(a) cradle means for carrying one of the rollers for pivotal swinging movement about an axis that traverses the rotational axis of the roller and passes through a point intermediate its ends;

(b) the cradle means being swingable in opposite directions about said transverse axis to first and second positions corresponding to said first and second operative modes.

3. The combination defined by claim 2, wherein the control means comprises:

(a) first and second fluid actuators operatively engaging the cradle means and disposed to respectively move the cradle means to said first and second positions;

(b) and valve means adapted for connection to a source of pressurized fluid and responsive to the first and second signals to alternately actuate the first and second actuators.

4. The combination defined by claim 3, wherein the fluid actuators are single action and disposed on opposite sides of the cradle means remote from said transverse axis, whereby extension of one actuator effects retraction of the other.

5. The combination defined by claim 4, wherein the valve means is constructed and arranged to exhaust one actuator as it actuates the other.

6. The combination defined by claim 5, wherein the actuators are pneumatic, and the valve means exhausts the nonactuated actuator to atmosphere.

7. The combination defined by claim 3, wherein the valve means comprises a four-way solenoid valve having first and second operative positions for respectively actuating the first and second actuators.

8. The combination defined by claim 7, wherein the solenoid valve is moved to one of said first and second operative positions upon energization by said first signal, said second signal comprising a null signal permitting the solenoid to become deenergized, and the valve means further comprises means for biasing the solenoid valve to the other of said first and second positions upon the occurrence of said second signal.

9. The combination defined by claim 1, wherein the transverse pivot axis of the cradle means is perpendicular to the rotational axis of the associated roller and passes through its midpoint.

10. The combination defined by claim 1, wherein the photodetector means is constructed to generate said first signal a predetermined delay period after entry of the abrasive belt edge into the predetermined region, and to generate said second signal a predetermined delay period after the abrasive belt edge leaves the predetermined region, whereby the abrasive belt continues to move laterally a predetermined distance after being sensed by the photodetector means before its direction is reversed by the control means and tracking means.

11. The combination defined by claim 1, which further comprises mounting means for mounting the photodetector means to the cradle means.

12. The combination defined by claim 11, wherein the mounting means is constructed to permit adjustment of the photodetector means along the rotational axis of the associated roller.

13. The combination defined by claim 12, wherein the mounting means is constructed to permit adjustment of the photodetector means toward and away from the inner face of the abrasive belt.

14. The combination defined by claim 13, wherein the mounting means comprises a mounting bracket having elongated adjustment slots extending in the directions of adjustment, and a plurality of mounting screws extending through said adjustment slots into the cradle means.

* * * * *